US006044603A

United States Patent [19]

Bader

[11] Patent Number: 6,044,603

[45] **Date of Patent: *Apr. 4, 2000**

[54] LOAD-BEARING LIGHTWEIGHT INSULATING PANEL BUILDING COMPONENT

[76] Inventor: Harold Bader, 14250 NE. 18th Ave., Miami, Fla. 33181

[ * ] Notice: This patent is subject to a terminal disclaimer.

[21] Appl. No.: 09/032,128

[22] Filed: Feb. 27, 1998

Related U.S. Application Data

[63] Continuation-in-part of application No. 08/319,627, Oct. 7, 1994, Pat. No. 5,722,198.

[51] Int. Cl.[7] ..... E04C 2/38

[52] U.S. Cl. ..... 52/309.7; 52/309.2; 52/309.16; 52/601; 52/656.1; 52/779; 52/781; 52/794.1; 52/800.12; 52/800.18

[58] Field of Search ..... 52/309.2, 309.7, 52/309.16, 601, 794.1, 800.12, 800.18, 779, 781, 656.1

[56] References Cited

U.S. PATENT DOCUMENTS

| | | | |
|---|---|---|---|
| 2,682,235 | 6/1954 | Fuller . | |
| 2,881,717 | 4/1959 | Fuller . | |
| 2,905,113 | 9/1959 | Fuller . | |
| 2,914,074 | 11/1959 | Fuller . | |
| 3,139,957 | 7/1964 | Fuller . | |
| 3,197,927 | 8/1965 | Fuller . | |
| 3,203,144 | 8/1965 | Fuller . | |
| 3,810,336 | 5/1974 | Sadao . | |
| 4,242,848 | 1/1981 | Schoultz | 52/717.06 |
| 4,633,634 | 1/1987 | Nemmer et al. | 52/474 |
| 4,649,682 | 3/1987 | Barrett, Jr. | 52/601 X |
| 4,769,963 | 9/1988 | Meyerson . | |
| 4,813,193 | 3/1989 | Altizer | 52/210 |
| 5,335,472 | 8/1994 | Phllips | 52/742.14 |
| 5,524,400 | 6/1996 | Schmechel | 52/309.7 X |
| 5,722,198 | 3/1998 | Bader | 52/745.09 |

*Primary Examiner*—Christopher T. Kent

*Attorney, Agent, or Firm*—Robert J. Van Der Wall

[57] ABSTRACT

Disclosed is a lightweight, insulating panel building component comprised of a combination of a rigid insulation core in a composite structure with a plurality of structural materials, preferably steel. The steel members form a perimeter about the rigid insulation core providing structural strength, particularly taken in combination with the compressive strength of the core and the tensional and compressive strength of the structural members. These structural members include vertical members which provide support in compression, a cap member, a foot member, and optional external and interior facing. The cap and foot members are preferably in the form of a standard channel having a web dimension that is substantially similar to the thickness of the rigid insulation core and can fit thereabout at the periphery thereof.

Vertical members are fabricated using a ledge channel cross-section, also having a web dimension substantially similar to the thickness of the rigid insulation core and flanges of sufficient dimension for the purpose presently described. At the ends of the flanges are ledges which are disposed in engaging relationship and obedience to grooves in the rigid insulation core. The ledges are disposed in engaging relationship with said grooves to form a structure that exceeds the strength of both the steel and the rigid insulation core producing integral composite columns. The structural members forming the perimeter about the rigid insulation core are attached to each other using conventional fastening means such as by welding, or using screws or the like.

9 Claims, 6 Drawing Sheets

LOAD-BEARING LIGHTWEIGHT INSULATING PANEL BUILDING COMPONENT

CROSS REFERENCE TO OTHER APPLICATION

This application is a continuation-in-part of application Ser. No. 08/319,627, filed on Oct. 7, 1994, now U.S. Pat. No. 5,722,198 issued Mar. 3, 1998 and claims that filing date as to the common subject matter.

FIELD OF THE INVENTION

The present invention relates to the field of modular building components and, more particularly, to a panel building component which achieves great insulation and strength with light weight by using a composite of materials that produce a synergistic effect as a consequence of an interlocking relationship and makes use of the highly specific qualities of each material.

BACKGROUND OF THE INVENTION

Much of the construction of buildings in the industrialized world, particularly in the United States, is of two types, wood frame and various kinds of material, including wood to cover the framework, or steel, usually taken in combination with concrete in the form of prestressed concrete for framing and a variety of other materials to cover the same, frequently concrete block. On larger buildings, a prestressed concrete frame may be covered by glass, marble, stone, or the like. In all of the above cases, insulation, which has become ever more important in an increasingly energy conscience world, is frequently supplied as a separate layer interiorly of the outside structure above-described. When the covering material is concrete block, insulation in at least the exterior walls is frequently omitted.

In order to achieve economies in the cost of construction, various efforts have been made to utilize pre-fabricated materials. Of course, the ultimate in pre-fabrication is with mobile homes which are simply transported to the residence site, and usually then permanently fixed to a foundation. Other types of pre-fabricated or partially pre-fabricated construction methods are also well known such as A frame homes that are frequently used in rural areas as vacation retreats. There have also been very sophisticated structures such as geodesic dome type structures of a type advocated by the well known American inventor Richard Buckminster Fuller. Examples of United States patents of this species either by Fuller or his associates are U.S. Pat. No. 2,682,235 for a geodesic dome, U.S. Pat. No. 2,881,717 for a paper board dome, U.S. Pat. No. 2,905,113 for a plydome, U.S. Pat. No. 2,914,074 for a catenary (geodesic tent), and other similar references such as U.S. Pat. Nos. 3,063,521, 3,139, 957, 3,197,927, 3,203,144, and 3,810,336.

Another reference which pursues the notion of a building component utilizing a panel is Zeihbrunner, U.S. Pat. No. 4,646,502 which teaches a panel construction element and building construction system employing such elements. That reference illustrates a profile frame and a filler material with cover panels that cover both the filler material and the profile frame. The frame includes a complex cross-section of a type fabricated using an extrusion, which, in turn, leads to a substantially more expensive structure than that provided by the present invention without the interlocking advantages of the framing with the filler or polymeric material of the present invention.

Similarly, efforts have been made to provide modular building components which produce building walls combining the coverage of area with insulation benefits. Several of these include two patents to Meyerson, U.S. Pat. Nos. 4,769,963 and 5,086,599, both of which involve utilizing an expanded polymeric material taken in combination with aluminum sheet to produce a building panel with excellent insulation properties in a light weight construction component. To the extent that an expanded polymeric material is utilized in these references, they bear some resemblance to the present invention. However, the resulting walls lack any significant structural strength because they are merely the combination of flat and folded aluminum or similar type material in combination with the expanded polymeric material.

Nemmer, et al., U.S. Pat. No. 4,633,634, issued on Jan. 6, 1987, discloses a building side wall construction panel and method. Nemmer includes foam cores connected edge to edge by connecting studs, the studs being two C-shaped channels welded back-to-back. To assemble Nemmer, the studs are secured upright and the foam cores are slid vertically downward into the open C-shaped sides of the studs. A problem with the Nemmer method is that a workman would have to carry tall and possibly unwieldy foam cores to roof level and try to jam their edges into and all the way downward along the stud C-channels to the level of the foundation. This precarious procedure is difficult and places the workman at risk. The double C-shape stud design makes it impossible for the workman to set the cores individually into place from ground level.

Switzerland Patent Number 396,368 teaches an interior wall panel assembly. The back-to-back C-shaped studs require either the procedure set forth in Nemmer where cores are forced downward from roof level, or prefabrication of the entire wall in a horizontal plane followed by tilting the wall upright. A complete wall would be heavy and dangerously cumbersome for one or even several workmen to lift upright and position properly. Such a complete wall, if assembled off site, would also be prohibitively bulky and unwieldy to transport.

A rough translation of Switzerland patent 396,368 indicates that it discloses an interior panel which is not load-bearing. "It is quite known to use (provide) gauge frame and panel elements to build interior walls." Switzerland '368 patent, line 1. There is apparently no teaching that the panels (11, 12, 13, 14) are "rigid", and indeed they would not need to be rigid to function as non-load-bearing interior dividers or wall panels. The panels are formed of rectangular foam cores having channel members secured along the core edges. The channel members have a cross-section like those of Nemmer, except that ledges are provided along the longitudinal edges of the C-shaped channels. The ledges are fit into grooves in core faces near core edges, but these ledges would not necessarily retain the insulation core against buckling under vertical compression loading.

The Switzerland channel flanges are revealed to be very flexible and loose in the groove, and indeed too flexible and loose to be capable of retaining the core under vertical loading. Switzerland FIG. 2 shows a composite panel wall only partially assembled, which is described as a "dividing wall in building procedure". Two of the individual cores do not yet have channel members on their top edges. One can see the empty groove along the top edge of each. Yet to complete the wall, such a top channel member must be inserted on each of those top edges. A top channel member cannot be slid into the grooves from the side of the panel, because it is blocked by vertical members 30, 40 and 50. The only way to do so at this stage of the construction, without taking the wall apart again, would be to spread the channel flanges apart to fit over and around the top edge of the particular core. Then the flange walls would be released to resiliently snap into the core engaging grooves.

Given that this approach is the only direct way to make progress on the completion of this wall, this must be the intended assembly procedure. The top channel flanges are, presumably, of the same material and strength as the side channels. If the channel flanges are so soft and flexible that they can be readily spread apart for installation, the channel flanges are clearly too soft and flexible to retain the core against buckling under the vertical compression loading typical of outer wall panels. If the core grooves are wide enough to let the channel ledges pivot down and around into them, they are too wide to securely retain the ledges under core loading. The flanges would simply spring apart and let the core buckle and fail. Of course, the Switzerland channel flanges do not have to carry a load, since they are apparently part of an interior wall structure.

An additional reference is Olton, U.S. Pat. No. 3,271,919, which teaches the use of a flanged channel disposed in opposed and parallel grooves which is used as a door edge protector. However, this reference does not teach load-bearing capability, insulation properties, nor especially the synergistic effect achieved by a composite of materials in an interlocking relationship that makes use of the highly specific qualities of each material, i.e., the compressive strength of the rigid insulation core to maintain the positional integrity of the steel of the vertical member, avoiding lateral deflection thereof, and the steel preventing buckling of the lateral portions of the rigid insulation core.

The present invention relates to a unique composite assembly that may be utilized for the construction of walls, roofs, and flooring, for a variety of structures and buildings. The preferred materials are steel for structural strength in a very specific interlocking relationship with an expanded polymeric material such as medium density polystyrene or polyurethane. The steel provides strength in both tension and compression, while the expanded polymeric material provides thermal and sound insulation and substantial support in compression. The combination, therefore, provides a structural strength that is believed to be absent from the Meyerson references while at the same time providing the high insulation effects that these Meyerson references would be expected to provide, as well as having the advantage of low cost resulting in part from pre-fabrication and the ability to utilize the same in combination with external and internal facing materials that provide aesthetics, protection from the elements, functionality, some additional insulation, and minimal construction labor. Indeed, the present invention produces an excellent substitute for concrete block when the same is used with a prestressed concrete frame, and with the optional exterior and/or interior surfaces, can also replace the materials normally applied to the exterior and/or interior of concrete block.

The lightweight nature of the present invention also permits the assembly of a load-bearing, insulating building wall using only a single workman without the need for lifting equipment. Load-bearing, insulating panels of a size and weight which can be carried by a single workman are set upright and secured in place one at a time to progressively form a wall.

SUMMARY OF THE INVENTION

Bearing in mind the foregoing, it is a principal object of the invention to provide panel building component that is lightweight, low cost, has strong insulation properties, and excellent structural qualities.

Another object of the invention is to provide a panel building component that cooperates with a plurality of external and/or internal facing materials to produce an attractive, functional, and fire resistant structure.

A further object of the invention is to provide a load-bearing, lightweight, insulating panel building component that is suitable for the replacement of concrete block construction.

A related object of the invention is to eliminate the waste as caused by the use of concrete blocks such as the additional ten percent builders normally order for breakage as well as the added waste when window and door openings are not eliminated from estimates.

Another object of the invention is to provide a load-bearing, lightweight, insulating panel building component which eliminates the need for tie beams, columns, furring, and insulation.

A further object of the invention is to provide a load-bearing, lightweight, insulating panel building component which allows the finished materials to be laminated directly to the wall surface in a pre-fabricated format.

One more object of the invention is to reduce construction site clean-up costs as is caused by block, stucco, furring, tie beam and column work.

Another object of the invention is to reduce time consuming and expensive inspections on columns and tie beams.

Yet another object is to provide a load-bearing, lightweight, insulating panel building component which permits pre-fabrication using optimum materials assembled under plant controlled conditions because of its pre-fabrication characteristics.

An additional object of the invention is to provide a lightweight, insulating panel building component capable of mass production in a high productivity and quality controlled environment at minimum cost.

A further object of the invention is to provide a lightweight, insulating panel building component which can be completed in a manufacturing plant with pre-installation of doors and windows and which can be pre-wired for electricity and other installations.

A still further object of the invention is to provide a lightweight, insulating panel building component which will not shrink, swell, or warp out of its designed shape, and will be unaffected by climatic changes, rot, or vermin.

One more object of the invention is to provide a load-bearing wall assembly which can be safely executed by a single workman without need of heavy equipment.

Other objects and advantages of the present invention will become apparent to those skilled in the art upon examination of the following detailed descriptions and the drawings.

In accordance with the principal aspect of the present invention, there is provided a lightweight, insulating panel building component comprised of a combination of a rigid insulation core in a composite structure with a plurality of structural materials, preferably steel. The steel members form a perimeter about the rigid insulation core providing structural strength, particularly taken in combination with the compressive strength of the core and the tensional and compressive strength of the structural members. These structural members include vertical members which provide support in compression, a cap member, a foot member, and optional external and interior facing. The cap and foot members are preferably in the form of a standard channel having a web dimension that is substantially similar to the thickness of the rigid insulation core and can fit thereabout at the periphery thereof.

Vertical members are fabricated using a ledge channel cross-section, also having a web dimension substantially similar to the thickness of the rigid insulation core and flanges of sufficient dimension for the purpose presently described. At the ends of the flanges are ledges which are disposed in engaging relationship and obedience to grooves in the rigid insulation core. The ledges are disposed in engaging relationship with said grooves to form a structure that exceeds the strength of both the steel and the rigid insulation core producing column of integral, but composite configuration referred to as integral composite columns. The structural members forming the perimeter about the rigid insulation core are attached to each other using conventional fastening means such as by welding, or using screws or the like.

BRIEF DESCRIPTION OF THE DRAWINGS

The invention will be better understood upon reference to the following detailed description and the drawings in which.

DETAILED DESCRIPTION OF THE PREFERRED EMBODIMENTS

Figure 1:
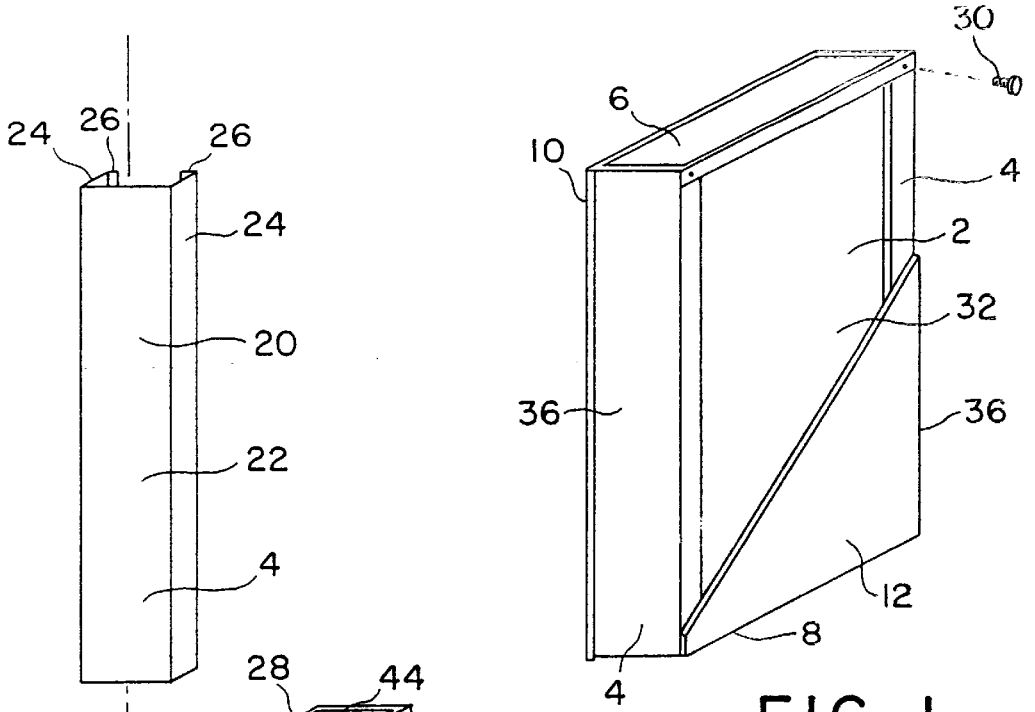
FIG. 1 is a perspective partially broken away view of the lightweight, insulating panel building component.

FIG. 1 illustrates in perspective view the inventive panel building component. A rigid insulation core 2 is preferably formed of an expanded polystyrene or similar expanded polymeric material, sometimes referred to as foam, having a high insulative characteristic and substantial strength in compression. The rigid insulation core has an interior face, an exterior face, opposing first and second side edges each having a vertical length, and a top edge and a bottom edge each having a width. The rigid insulation core 2 is surrounded about its periphery by a plurality of structural members including vertical members 4, a cap member 6, and a foot member 8. These structural members about the perimeter of rigid insulation core 2 may be attached at their intersections by conventional fastening means such as by welding or by at least one screw 30.

Optionally disposed in laminated association with the panel is an external facing 10 such as siding, reflective glass, a simulated stucco material, or the like. Such material can provide substantial aesthetics as well as add additional support and possible also insulative effects. Also shown is an optional internal facing material, such as a gypsum panel 12. Following installation of the panel in a construction site, wallpaper, paint, or other decorative materials may be readily applied to optional interior facing 12. Interior facing 12 is also preferably a fire resistant material, typically a five-eighths inch gypsum drywall having a finish rating of not less than sixty minutes. In fact, because of the importance of this feature for previously obtained approvals from code and other governmental agencies, the optional interior facing is shown disposed within the flanges of the cap and foot members, although the same may certainly be disposed in a laminated relationship exteriorly of these flanges.

Of greatest significance concerning this invention is the efficiency of materials in creating a building component of great strength and light weight. The interlocking aspects of the vertical members with lateral portions of rigid insulation core produce integral composite columns having great strength.

Figure 2:
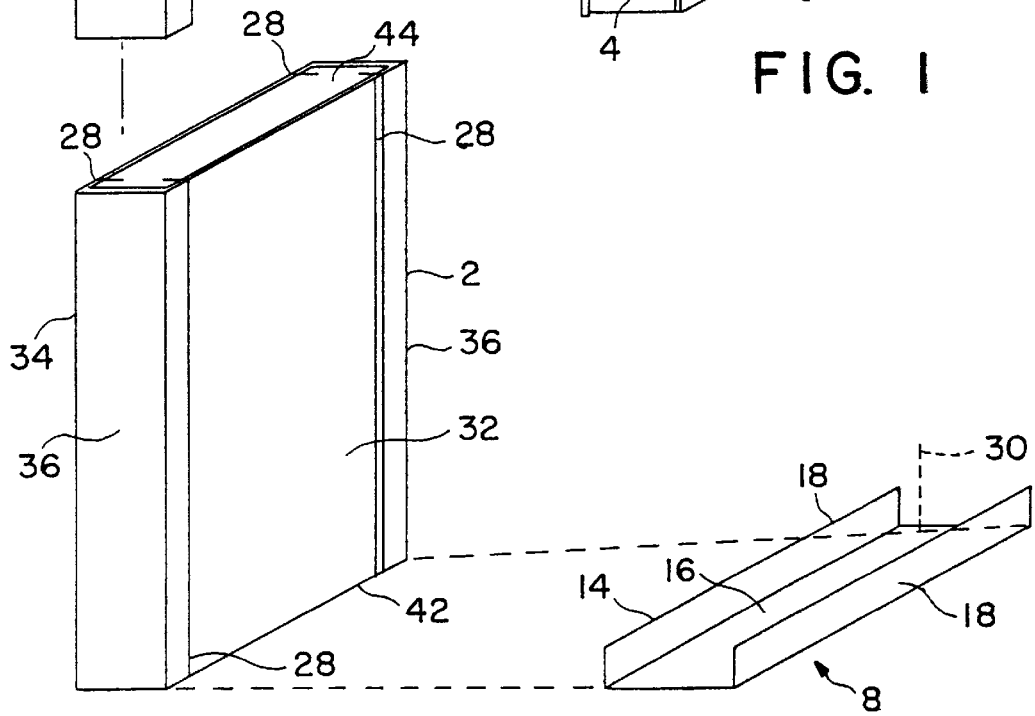
FIG. 2 is a perspective view of the rigid insulation core illustrating in exploded relationship one vertical member and one foot member from which the panel building component is constructed.

FIG. 2 shows the unadorned rigid insulation core 2 after the same has been embossed with rigid insulation grooves 28 which are shown in four locations. More specifically, a first pair of grooves is provided with one groove being in the interior face of the rigid insulation core and with another groove in the exterior face of the rigid insulation core, both being substantially parallel with and spaced apart from the first side edge. A second pair of grooves is provided in the interior and exterior faces substantially parallel with and spaced apart from the second side edge. These rigid insulation grooves are disposed to receive in engaging relationship portions of the vertical member 4 as hereinafter described.

Turning first to the foot member 8, it will be seen that in cross-section the foot member 8 has a standard channel 14 having a standard channel web 16 and standard channel flanges 18. It has a web portion with two longitudinal edges, a flange portion at each web portion longitudinal edge, and an opening. The foot member is substantially the width of the bottom edge of the rigid insulation core and disposed at the opening over the bottom edge of the rigid insulation core.

Turning next to cap member 6, it has a web portion with two longitudinal edges, a flange portion at each web portion longitudinal edge, and an opening to fit over the rigid insulation core. The cap member is substantially the width of the top edge of the rigid insulation core.

First and second vertical members 4 each have a web portion 22 with web portion longitudinal edges, ledge channel flanges 24 terminating in ledges 26 and a vertical length substantially equal to the vertical length of the first and second side edges of the rigid insulation core. Ledges 26 are intended to be disposed in engaging relationship with rigid insulation grooves 28 when vertical member 4 is assembled with rigid insulation core 2 substantially covering the first and second side edges of the rigid insulation core, thereby forming first and second integral composite columns of great strength. Grooves 28 preferably have a width relative to ledge 26 thickness to closely and snugly receive a ledge 26. This snug ledge 26 fit ensures a tight, high friction ledge 26 engagement in a groove 28 while panel 40 is under loading. The high friction engagement of ledge 26 helps retain the ledge 26 within groove 28. This great strength is achieved because the integral composite column thereby created utilizes the advantage of the compressive strength of the rigid insulation material to maintain the positional integrity of the steel of the vertical member 4, thereby avoiding lateral deflection thereof. In a complimentary manner, the steel prevents buckling of the lateral portions of the rigid insulation core disposed within the ledge channel cross-section of the vertical members 4. Relatively light gauge steel has in some instances, for relatively light wall loading, been found satisfactory. Simultaneously, the lateral portions of the rigid insulation core disposed within vertical members 4 remain integral with the remainder of the rigid insulation core that forms the central portion of the panel. Similar strength advantages are achieved with the cap member 6 and foot member 8, but the strength of the integral composite column is not ordinarily needed in the horizontal direction.

In special applications, the ledge channel configuration may be employed for the cap member 6 and/or foot member 8 as required. In such event, the rigid insulation core 2 would be furnished with corresponding grooves to achieve an engaging relationship with the ledges to be added to the cap member 6 and/or foot member 8.

Figure 3:
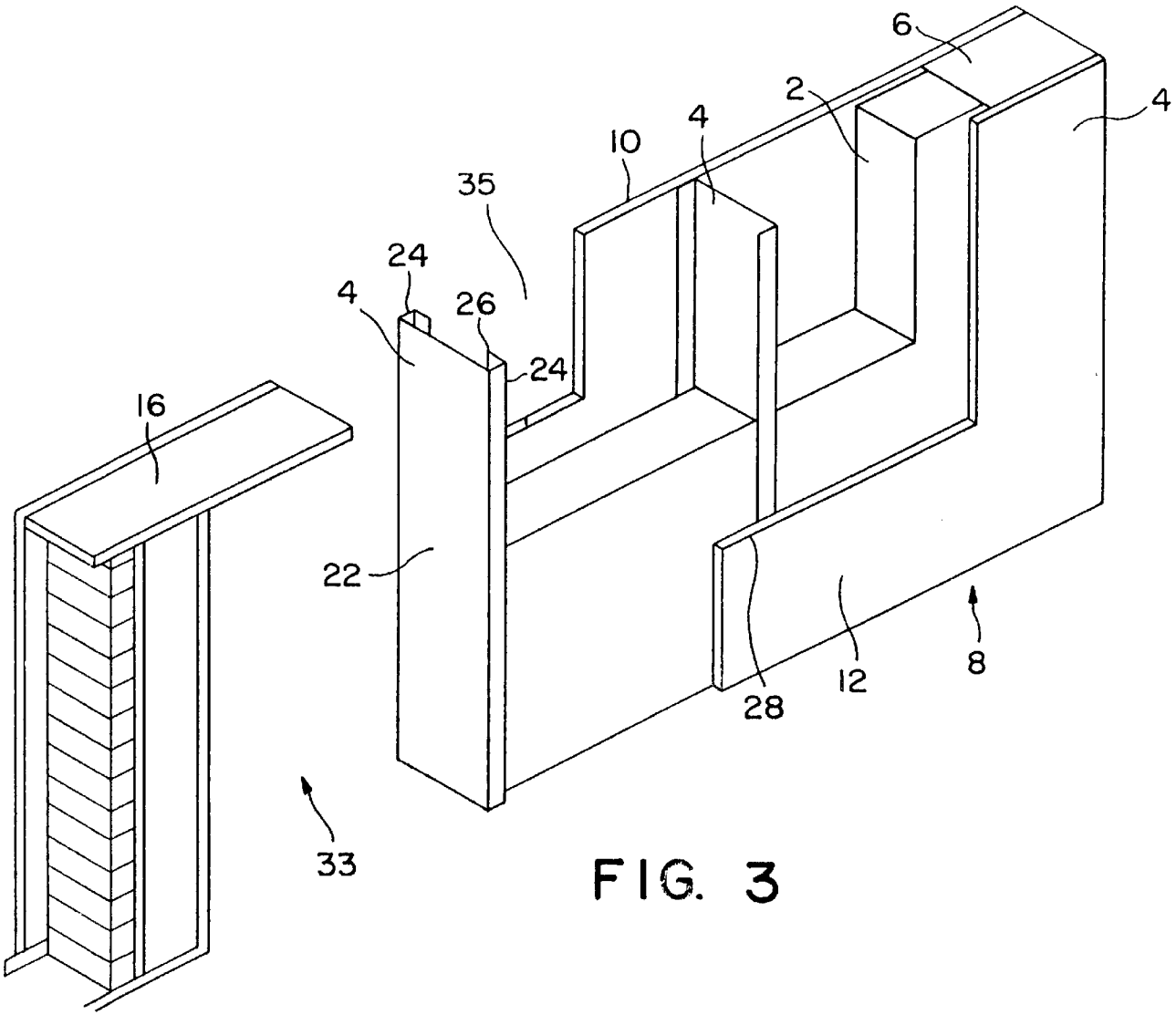
FIG. 3 show a partially broken away wall constructed of the lightweight, insulating panel building component and illustrating the disposition of window and door openings.
Figure 4:
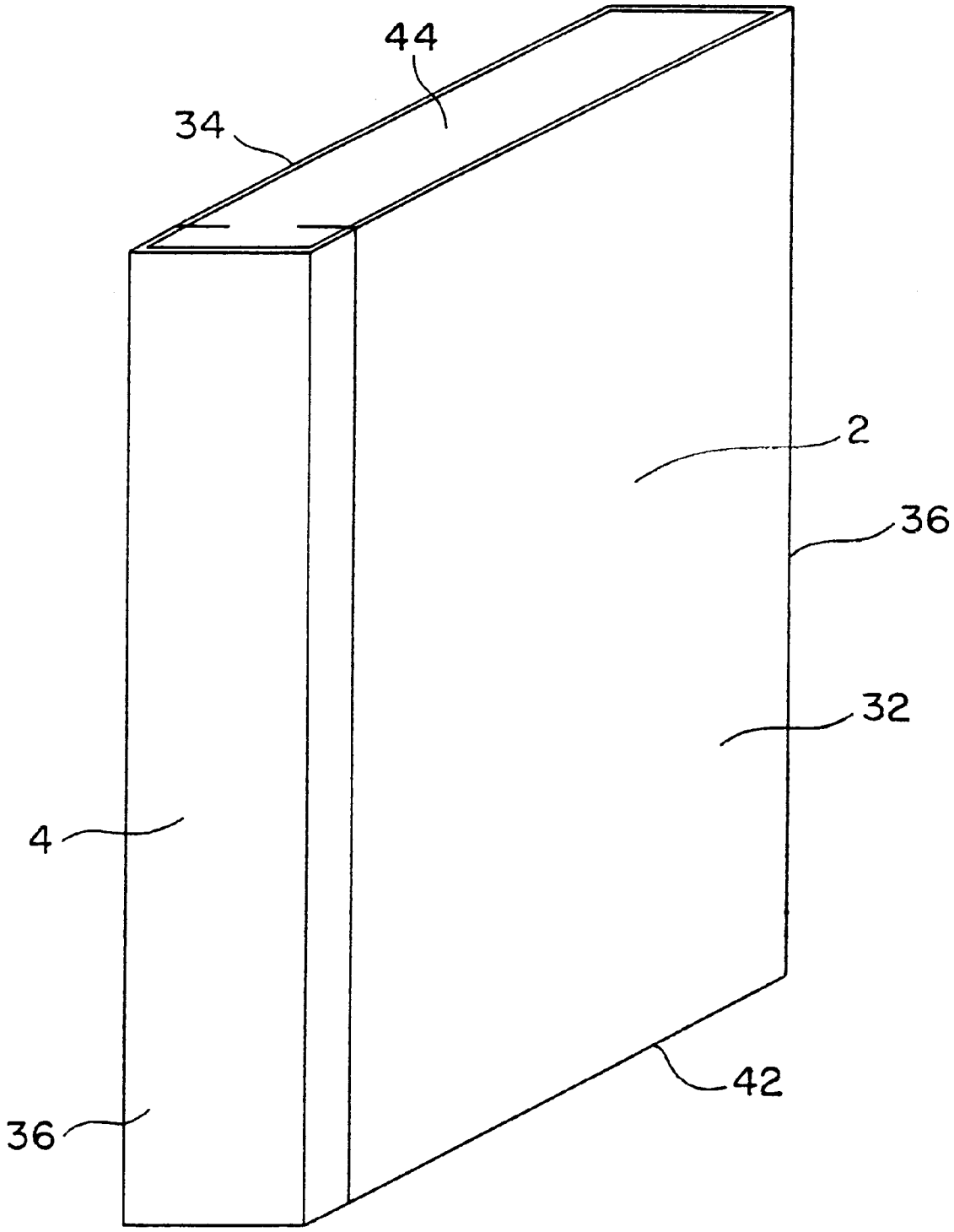
FIG. 4 is a view as in FIG. 2, except that the vertical member is fully inserted into the grooves.
Figure 5:
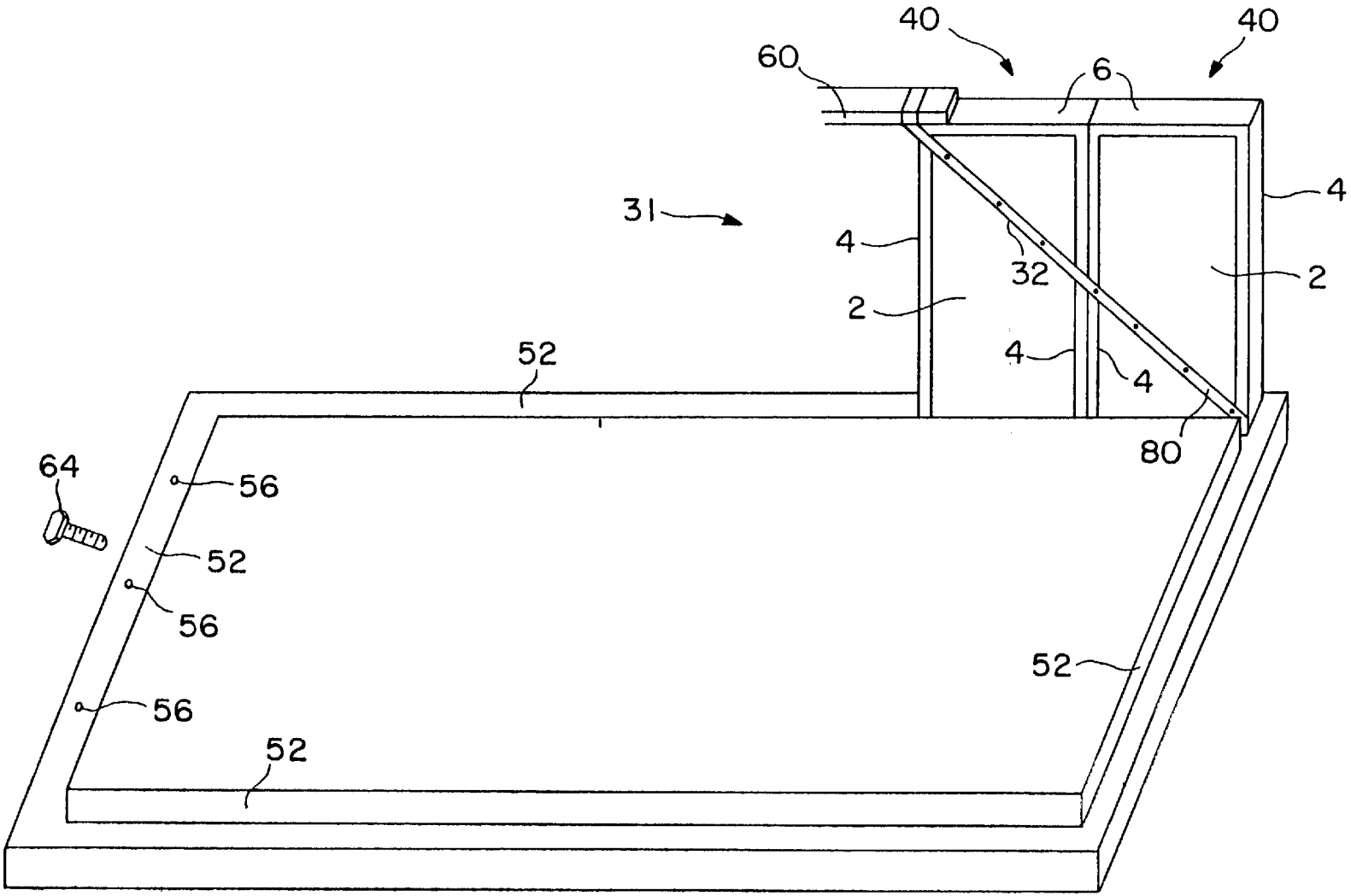
FIG. 5 is a perspective view of a building foundation with two panels secured into the elongate recess provided along the perimeter of the foundation.
Figure 6:
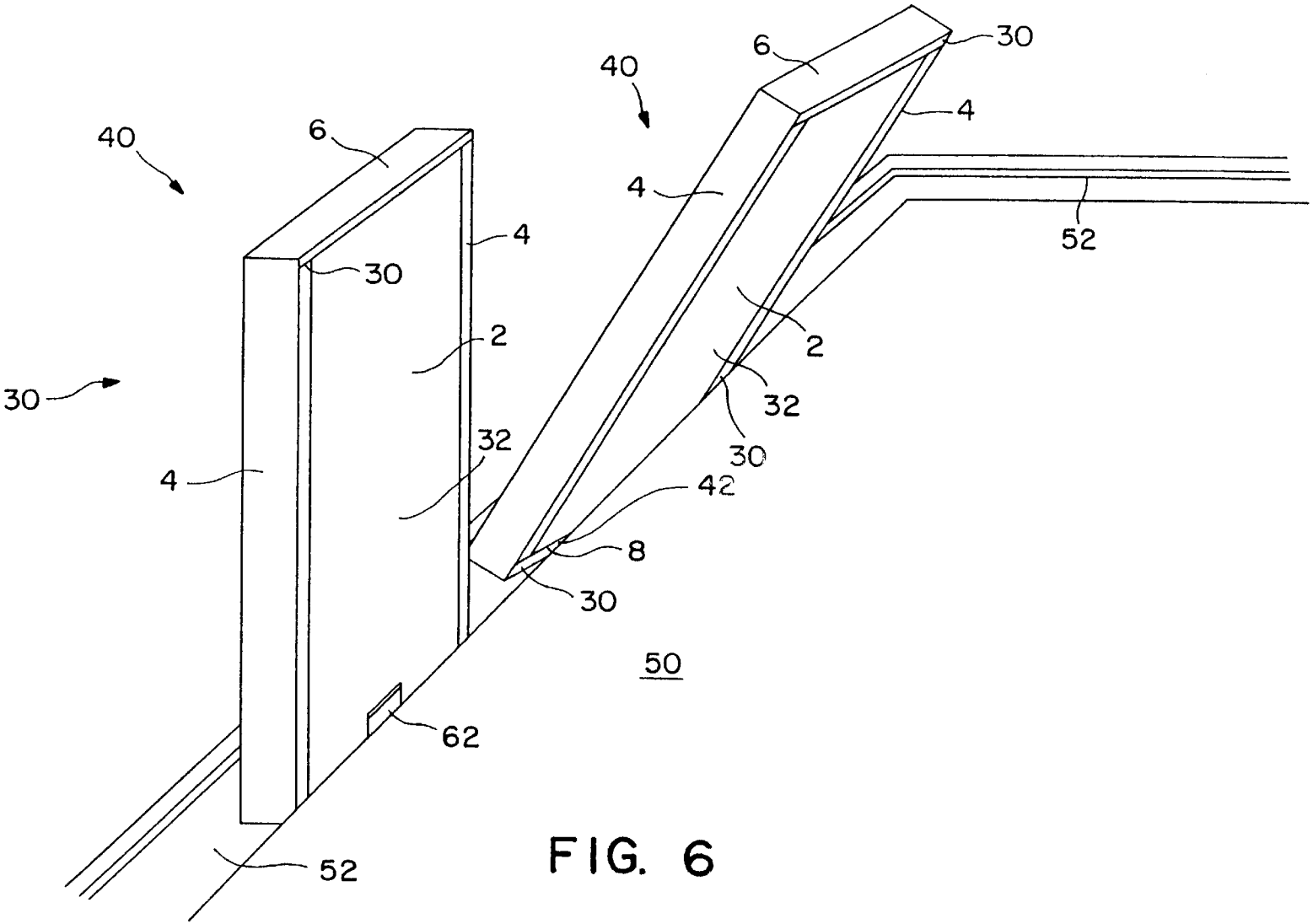
FIG. 6 is a perspective close-up view of a building foundation with one panel set upright in the recess and another being set into place next to it.
Figure 7:
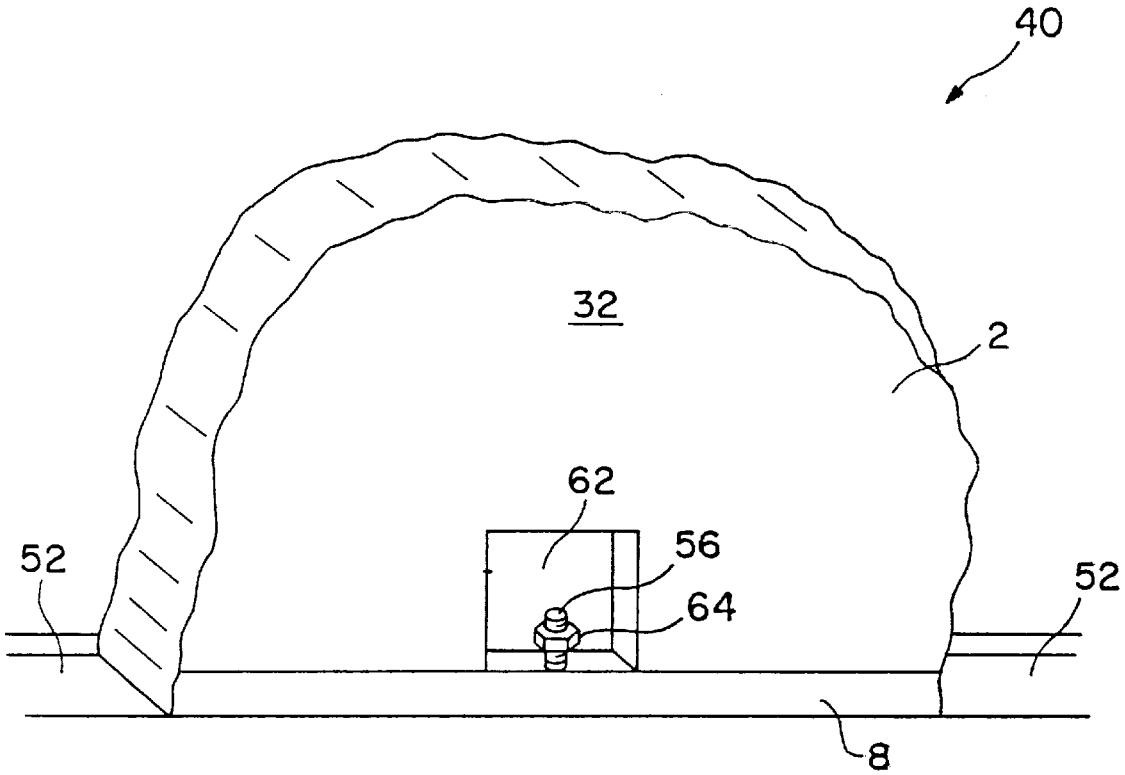
FIG. 7 is a close-up, broken away, front perspective view of the rigid insulation core containing a void, as shown in the nearest lightweight, insulating panel building component in FIG. 6, revealing the securing element, in this instance a nut, being screwed onto the concrete fastener element protruding upwardly from the foundation recess, to secure the lightweight, insulating panel building component within the recess.

Turning to FIG. 3, there is shown in partially broken away view a wall constructed using the panel building component. Illustrated therein particularly is an door opening 32 and a window cut-out 34 which window cut-out is shown only in the external facing 10. The rigid insulation core 2 is undercut to show the relationship thereof with vertical members 4. Also undercut is internal facing 12 and cap member 6. Also seen is the edge of foot member 8. Although the door and window are not illustrated, it will be readily appreciated that said items can be installed into the inventive panel building component at the factory manufacturing site.

Of particular interest in this figure is the utilization of three vertical members 4 in a single panel. Such panels are frequently four feet wide by eight feet high, although other dimensions are within the contemplation of the inventor. Depending upon the strength requirements for a particular edifice including those imposed by local building codes, it is appropriate to use more than two integral composite columns in a single panel. For example, in a location where a wall would ordinarily have studs on two foot centers, the same spacing can be achieved by using one additional integral composite column two feet from either lateral edge of a four foot wide panel. FIG. 3 illustrates how this is accomplished.

Careful examination of FIG. 3 also shows the interrelationship of the rigid insulation core 2 with the channel ledges 26 which are disposed within rigid insulation grooves 28. The width of the ledge channel web 22 and the standard channel web 16 is seen to be substantially equivalent to the thickness of rigid insulation core 2.

Having described the presently preferred embodiments of the invention, it should be understood that various changes in construction and arrangement will be apparent to those skilled in the art and fully contemplated herein without departing from the true spirit of invention. Accordingly, there is covered all alternatives, modifications and equivalents as may be included within the spirit and scope of the invention as defined in the appended claims.

What is claimed is:

1. A load-bearing, lightweight, insulating panel building component comprising:

a rigid insulation core having an interior face, an exterior face, opposing first and second side edges each having a vertical length, and a top edge and a bottom edge each having a width;

a first pair of grooves with one groove being in said interior face and with another groove in said exterior face, both being substantially parallel with and spaced apart from said first side edge;

a second pair of grooves in said interior face and in said exterior face substantially parallel with and spaced apart from said second side edge;

first and second vertical members each having a web portion with web portion longitudinal edges, a flange portion at each said web portion longitudinal edge, said flange portions each having a flange portion longitudinal edge, a ledge at each said flange portion longitudinal edge, and a vertical length substantially equal to the vertical length of the first and second side edges of the rigid insulation core, said first and second vertical members being disposed in engaging relationship with the pairs of grooves and substantially covering the first and second side edges of the rigid insulation core, thereby forming first and second integral composite columns of great strength;

a foot member having a web portion with two longitudinal edges, a flange portion at each said web portion longitudinal edge, and an opening, said foot member being substantially the width of the bottom edge of the rigid insulation core and disposed at the opening over the bottom edge of the rigid insulation core;

a cap member having a web portion with two longitudinal edges, a flange portion at each said web portion longitudinal edge, and an opening, said cap member being substantially the width of the top edge of the rigid insulation core and disposed at the opening over the top edge thereof; and fastening means fixedly attaching the integral composite columns, cap member, and foot member to each other about the rigid insulation core.

2. The load-bearing, lightweight, insulating panel building component of claim 1 in which the fastening means is welding.

3. The load-bearing, lightweight, insulating panel building component of claim 1 in which the fastening means are screws.

4. The load-bearing, lightweight, insulating panel building component of claim 1 wherein the vertical members are fabricated from metal.

5. The load-bearing, lightweight, insulating panel building component of claim 4 wherein the metal is light gauge steel.

6. The load-bearing, lightweight, insulating panel building component of claim 1 wherein the rigid insulation core is medium density expanded polystyrene foam.

7. The load-bearing, lightweight, insulating panel building component of claim 1 which further comprises an internal facing material laminated to the interior face of the rigid insulation core.

8. The load-bearing, lightweight, insulating panel building component of claim 7 in which the interior facing material is comprised of a fire resistant substance.

9. The load-bearing, lightweight, insulating panel building component of claim 1 which further comprises an external facing material laminated to the exterior face of the rigid insulation core.

* * * * *